US007668493B2

(12) United States Patent
Ruiz et al.

(10) Patent No.: US 7,668,493 B2
(45) Date of Patent: Feb. 23, 2010

(54) FLEXIBLE MEDIA TRAVEL ADJUSTING MEANS AND AN IMAGE FORMING DEVICE INCLUDING THE SAME

(75) Inventors: Erwin Ruiz, Rochester, NY (US); Gregory P. Miller, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 532 days.

(21) Appl. No.: 11/546,198

(22) Filed: Oct. 11, 2006

(65) Prior Publication Data

US 2008/0145124 A1 Jun. 19, 2008

(51) Int. Cl.
*B65H 29/70* (2006.01)
*G03G 15/20* (2006.01)

(52) U.S. Cl. ..... 399/322; 399/323; 399/397; 399/406

(58) Field of Classification Search ..... 399/323, 399/322

See application file for complete search history.

(56) References Cited

U.S. PATENT DOCUMENTS 5,245,395 A * 9/1993 Pawlik et al. ..... 399/322
6,205,316 B1 * 3/2001 Iida ..... 399/323

FOREIGN PATENT DOCUMENTS

JP 60225181 A * 11/1985
JP 03004279 A * 1/1991
JP 2001005328 A * 1/2001

* cited by examiner

*Primary Examiner*—Daniel J Colilla
(74) *Attorney, Agent, or Firm*—Gibb I.P. Law Firm, LLC

(57) ABSTRACT

An image forming device includes one or more flexible fingers to simulate a narrow gap baffle and provide a baffle-like support for different document media. These flexible fingers help guide the documents from one subsystem to another, for instance, entering into the decurler nip on the host image forming device decurler assembly. These flexible fingers act as two baffles. For heavy weight documents, the flexible fingers deflect and move out of the way. For medium to light weight documents, the flexible fingers control the document position during its trajectory.

20 Claims, 9 Drawing Sheets

FLEXIBLE MEDIA TRAVEL ADJUSTING MEANS AND AN IMAGE FORMING DEVICE INCLUDING THE SAME

INCORPORATION BY REFERENCE OF OTHER PATENTS, PENDING PATENT APPLICATIONS AND PUBLICATIONS

This application is related to pending application Ser. No. 11/058,031 filed on 15 Feb. 2005 by Gregory P. Miller, Erwin Ruiz et al., entitled "Stripper assembly and a printing machine including the same", assigned to Xerox Corporation, which application was published on 17 Aug. 2006 as U.S. Patent Application Publication No. US 2006/0182478, the disclosure of which pending application in its entirety hereby is totally incorporated herein by reference.

The disclosures of the following U.S. patents in their entirety hereby are totally incorporated herein by reference: William R. Klimley et al., U.S. Pat. No. 6,963,717, "Fuser stripper baffle and a printing machine including the same", issued 8 Nov. 2005; and Kenneth R. Rasch, Erwin Ruiz, Gregory P. Miller et al., U.S. Pat. No. 6,782,228, "Intermittent stripper fingers and baffle for stripping copy media from a heated fuser roll", issued 24 Aug. 2004; both foregoing U.S. patents being assigned to Xerox Corporation.

BACKGROUND OF THE INVENTION

Image forming devices are known. For example, such image forming devices include copiers and printers. In most image forming device designs, documents are typically controlled by baffles and guides. Ideally we want to have a very narrow gap (3-5 mm) between the upper or "decurler entrance" baffle and the lower or "fuser stripper" baffle in order to control the position of the document. The wider the distance between the baffles, the more challenging it is to control the paper.

In applications such as the image forming device Nuvera's fuser assembly, the document is not completely controlled or properly guided into the decurler nip roll.

NOTE: The term "NUVERA" is a trademark of Xerox Corporation, P.O. Box 1600, 800 Long Ridge Road, Stamford, Conn. 06904.

For this particular application, heavy weight documents will travel at a different paper trajectory than light weight documents. As a result, the current design has to be wide enough to accommodate the different paper trajectories. Having a wider entrance aperture or throat, will sacrifice the performance of some documents. For the Nuvera fuser assembly, light medium to light weight documents can bounce around and miss the decurler nip, hitting the roll in an undesired area, thereby creating a paper jam or document defect known as a 51 mm "ding".

The image forming device includes a fuser assembly wherein heavy weight document's trajectory is very predictable. For light weight documents, the document not only has a different trajectory but its path is not as predictable as the heavier document. This path could be affected by document variations such as paper curl (simplex-duplex), image area coverage, paper type, and so forth.

In the past, this problem was addressed by simply relying on the operator to clear the paper jam, and/or restricting paper weight/type machine can reliably feed without defect or paper jam.

Thus, there is a need for the present invention.

BRIEF SUMMARY OF THE INVENTION

In a first aspect of the invention, there is described apparatus comprising one or more flexible media travel adjusting means disposed on an included baffle; the one or more flexible media travel adjusting means arranged to face a proximate fuser stripper baffle; and the one or more flexible travel adjusting means arranged to guide a traveling media towards a decurler nip of a proximate decurler assembly.

In a second aspect of the invention, there is described an image forming device including one or more flexible media travel adjusting means disposed on an included baffle; the one or more flexible media travel adjusting means arranged to face a proximate fuser stripper baffle; and the one or more flexible travel adjusting means arranged to guide a traveling media towards a decurler nip of a proximate decurler assembly.

In a third aspect of the invention, there is described an image forming device comprising one or more flexible media travel adjusting means arranged to apply a media travel adjusting force to a printed media, the printed media thereby being urged and guided to follow an adjusted media travel path.

DETAILED DESCRIPTION OF THE INVENTION

Briefly, in accordance with the present invention, there is provided an image forming device 300 including one or more flexible fingers 3 and 30 to simulate a narrow gap baffle and provide a baffle-like support for different document media. These flexible fingers 3 and 30 help guide the documents from one subsystem to another, for instance, entering into the decurler nip 63 on the host image forming device decurler assembly 60. These flexible fingers 3 and 30 act as two baffles. For heavy weight documents, the flexible fingers 3 and 30 deflect and move out of the way. For medium to light weight documents, the flexible fingers 3 and 30 control the document position during its trajectory.

Figure 1:
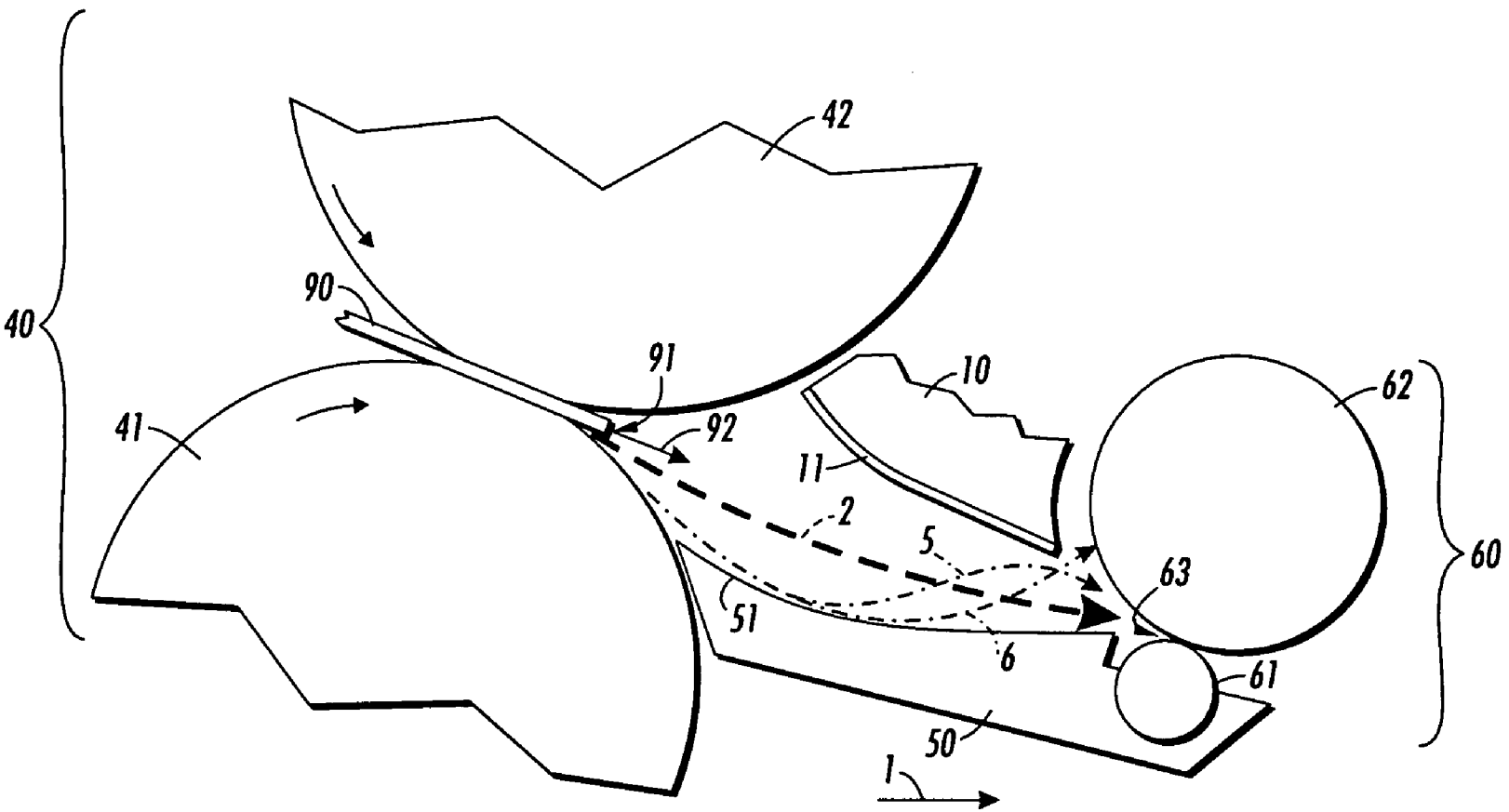
FIG. 1 is an attached cutaway profile view of a fuser assembly 40, a decurler assembly 60, a fuser stripper baffle 50 and an opposing upper baffle 10.

Referring now to FIG. 1 there is shown a fuser assembly 40, a decurler assembly 60, a fuser stripper baffle 50 and an opposing upper baffle 10. As shown, the fuser assembly 40 comprises a lower heated fuser roll 41 and an opposing upper fuser pressure roll 42. Also, the decurler assembly 60 comprises a lower decurler roll 61 and an opposing upper decurler foam roll 62, the foregoing decurler rolls 61 and 62 cooperating to define a decurler nip 63.

In one embodiment, the fuser stripper baffle is similar or identical to the fuser stripper baffle 20 of U.S. Pat. No. 6,963,717, "Fuser stripper baffle and a printing machine including the same", issued 8 Nov. 2005 to William R. Klimley et al., the disclosure of which patent is incorporated by reference herein, verbatim, and with the same effect as though such patent were presented herein in its entirety.

In one embodiment, the fuser stripper baffle is similar or identical to the fuser stripper baffle 34 of U.S. Pat. No. 6,782,228, "Intermittent stripper fingers and baffle for stripping copy media from a heated fuser roll", issued 24 Aug. 2004 to Kenneth R. Rasch, Erwin Ruiz, Gregory P. Miller et al., the disclosure of which patent is incorporated by reference herein, verbatim, and with the same effect as though such patent were presented herein in its entirety.

Also depicted in FIG. 1 are a process or "downstream" direction 1, a target media travel path 2, a first non-target media travel path 5 and a second non-target media travel path 6.

As shown in FIG. 1, the baffle 10 includes one or more baffle media travel guide means or ribs 11. Also shown is a post-fuser printed media or paper 90, a media leading edge 91 and a media leading edge vector 92. As shown, when the post-fuser printed media 90 travels in such a manner to generally adhere to the target media travel path 2, the printed media 90 is thereby advantageously urged and guided to successfully enter the decurler nip 63.

Figure 2:
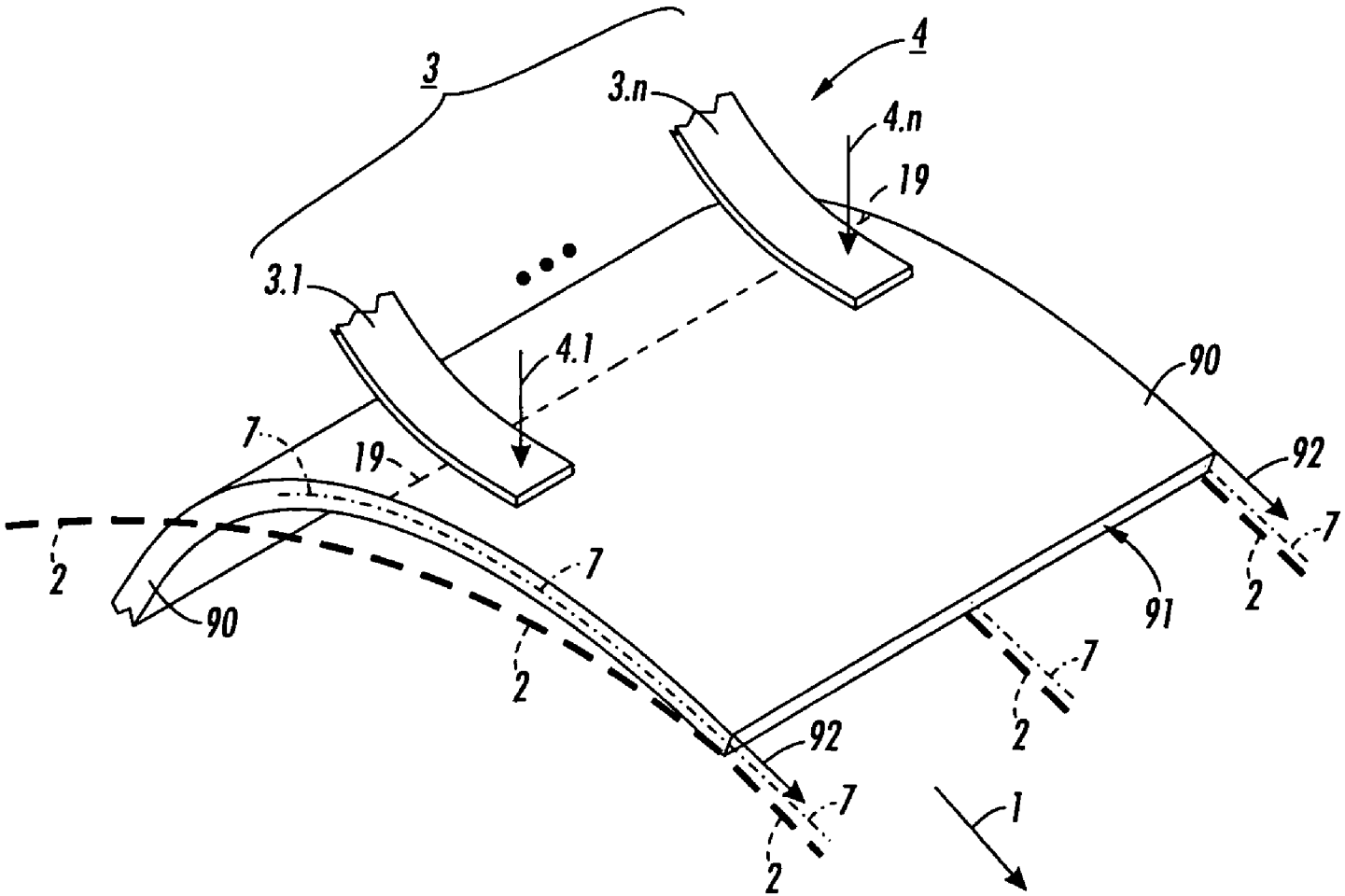
FIG. 2 depicts a first embodiment of a flexible media travel adjusting means, in accordance with the present invention. There is shown an elevated detached perspective view of one or more flexible media travel adjusting means 3 arranged to apply corresponding media travel adjusting forces 4 to a media 90.

Referring now to FIG. 2 there is shown a first embodiment of a flexible media travel adjusting means, in accordance with the present invention. There is shown one or more flexible media travel adjusting means 3 arranged to apply corresponding media travel adjusting forces 4 to a media 90.

Still referring to FIG. 2, in one embodiment the one or more flexible travel adjusting means 3 are advantageously arranged and employed in connection with the fuser assembly 40, fuser stripper baffle 50, decurler assembly 60 and media 90 as described above in connection with FIG. 1. In this embodiment, the FIG. 1 baffle 10 is optional. In other words, in this embodiment the baffle 10 is either provided and thus present, or else not provided and thus absent.

Referring still to FIG. 2, in one embodiment, the one or more flexible travel means 3 are supported by an included baffle which baffle is similar or identical to the baffle 10 of FIG. 1. In another embodiment, the one or more flexible travel means 3 are supported by means of an included bracket, which bracket is not shown in FIG. 2. In a further embodiment, the one or more travel means are supported by means of an included mounting, which mounting is not shown in FIG. 2.

Still referring to FIG. 2, in one embodiment, the one or more flexible travel adjusting means 3 comprise a plurality of quantity "n" flexible media travel adjusting means respectively depicted by the corresponding reference numbers 3.1 through 3.n. Thus, as shown, the flexible media travel adjusting means 3.1 through 3.n are arranged to apply corresponding media travel adjusting forces 4.1 through 4.n to the post-fuser printed media 90.

Referring still to FIG. 2, as a result of the media travel adjusting forces 4 applied by the flexible media travel adjusting means 3, the media 90 is accordingly urged and guided to follow an adjusted media travel path 7, with the adjusted media travel path 7 ultimately converging with the target media travel path 2.

Moreover, as shown in FIG. 2, as a result of the one or more flexible media travel adjusting means 3 applying the corresponding media travel adjusting force 4 to the post-fuser printed media 90, the media 90 is accordingly caused to travel in such a manner as to generally adhere to the target media travel path 2, with the ultimate advantageous result that the printed media 90 is thereby urged and guided to successfully enter a corresponding decurler nip such as, for example, the decurler nip 63 of FIG. 1.

Still referring to FIG. 2, in one embodiment the flexible media travel adjusting means 3 comprises an elongated finger. In one embodiment, the flexible finger 3 is comprised of full hard stainless spring steel. In another embodiment, the flexible finger 3 is comprised of another material or substance that is different from and not the same as the aforementioned "full hard stainless spring steel" material.

In one embodiment, the finger 3 comprises a thickness of about 0.1 millimeters or "mm".

In one embodiment, the finger 3 forms a circular-shaped arc having a radius of about 25 mm.

Figure 3:
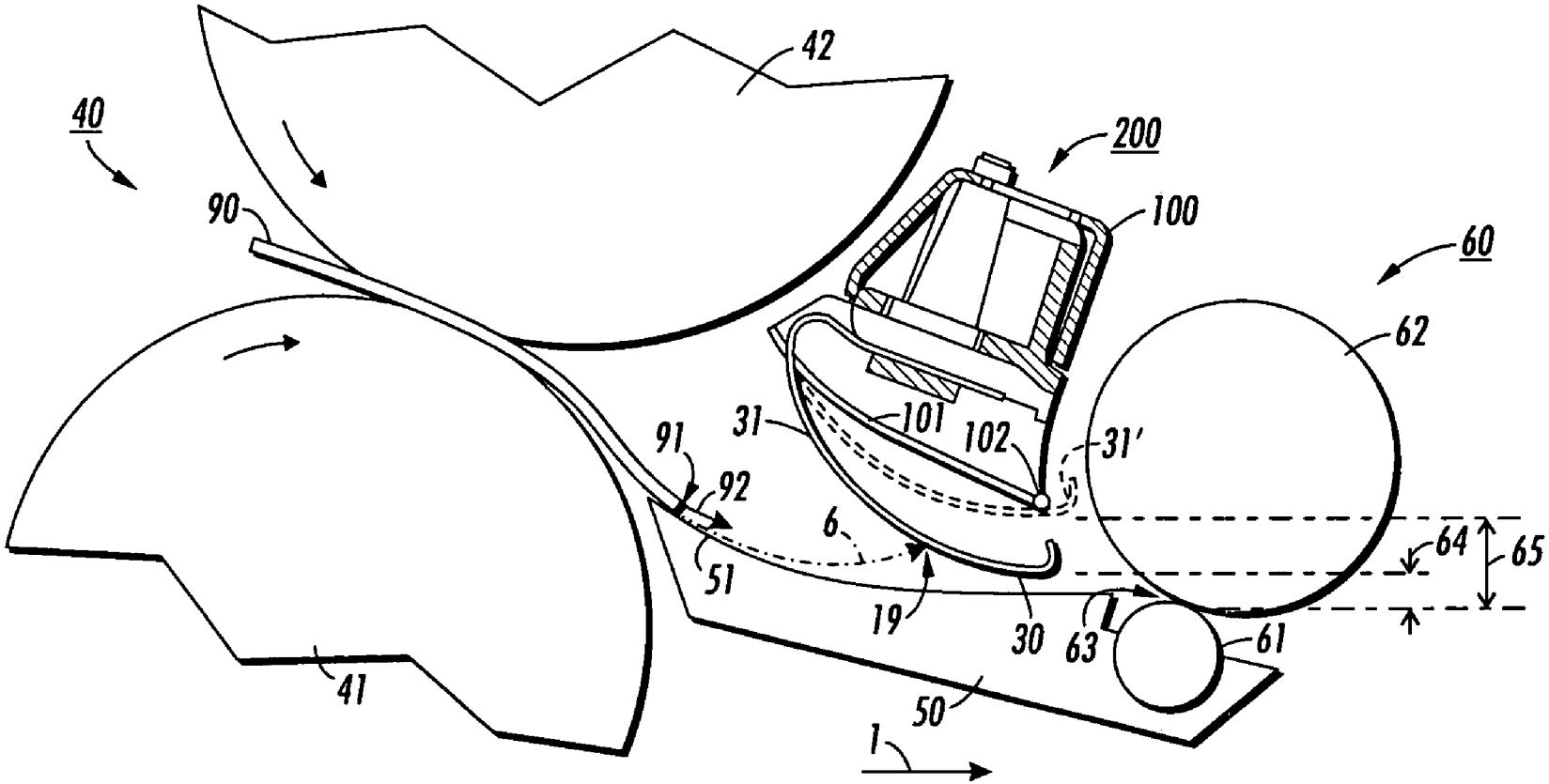
FIG. 3 depicts a second embodiment of a flexible media travel adjusting means, in accordance with the present invention. There is shown an attached cutaway profile view of the FIG. 1 fuser assembly 40, decurler assembly 60 and fuser stripper baffle 50 arranged with one or more flexible media travel adjusting means 30. As shown, the one or more flexible travel adjusting means 30 are supported, fixed, mounted, located, fastened, situated, positioned or disposed on an included baffle 100. The arrangement of the one or more flexible travel adjusting means 30 and the baffle 100 is depicted by reference number 200 in FIG. 3.

Referring now to FIG. 3 there is shown a second embodiment of a flexible media travel adjusting means, in accordance with the present invention. There is shown an attached cutaway profile view of the FIG. 1 fuser assembly 40, decurler assembly 60 and fuser stripper baffle 50 arranged with one or more flexible media travel adjusting means 30. As shown, the one or more flexible travel adjusting means 30 are disposed on an included baffle 100. The arrangement of the one or more flexible travel adjusting means 30 and the baffle 100 is depicted by reference number 200 in FIG. 3.

Referring still to FIG. 3, the flexible media travel adjusting means 30 includes a flexible media travel adjusting means media guide member, or finger 31.

As shown in FIG. 3, the media 90 travel path initially adheres to the non-target media travel path 6, which non-target media travel path 6 ultimately causes the media 90 to contact 19 the flexible media travel adjusting means media guide member, or finger 31. As shown, the baffle 100 includes a baffle flexible media travel adjusting means travel stop, or over-travel feature 102. Also depicted is a decurler light weight media entrance aperture or "throat" 64 and a decurler heavy weight media entrance aperture or throat 65.

In one embodiment, the decurler light weight media entrance aperture or throat 64 has a value of 2.6 millimeters or 2.6 "mm".

Also in one embodiment, the decurler heavy weight media entrance aperture or throat 65 has a value of 8.6 mm.

Figure 4:
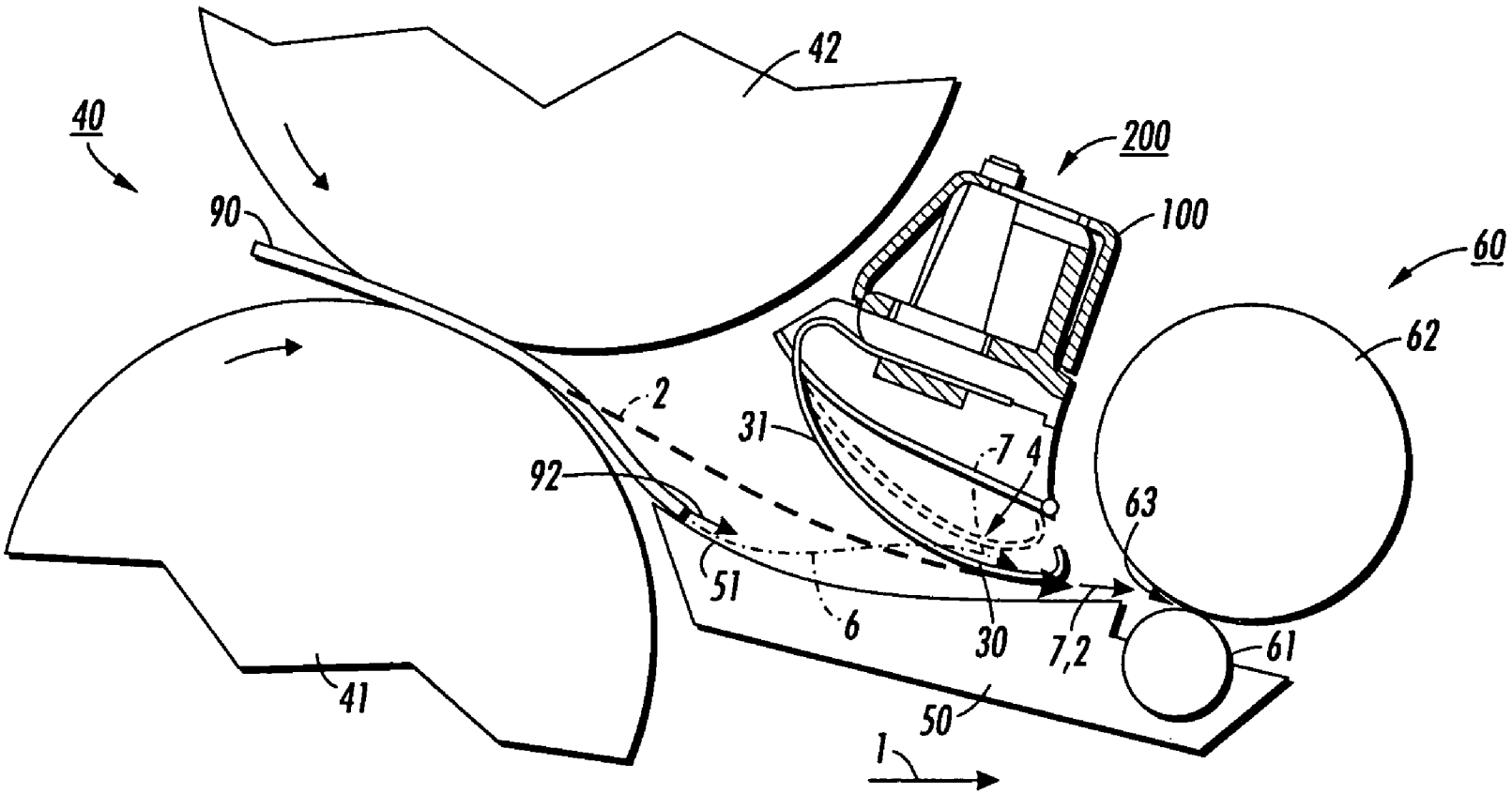
FIG. 4 depicts the FIG. 3 flexible media travel adjusting means 30 contacting the media 90 to thereby apply a media travel adjusting force 4 to the media 90.

Referring now to FIG. 4 there is shown the FIG. 3 flexible media travel adjusting means 30 contacting the media 90 to thereby apply a media travel adjusting force 4 to the media 90. As a result of the media travel adjusting force 4 being applied by the flexible media travel adjusting means 30, the media is caused to deviate from the prior non-target media travel path 6 and follow the new adjusted media travel path 7, with the adjusted media travel path 7 ultimately converging with the desired target media travel path 2. Moreover, as a result of the media 90 traveling in such a manner to ultimately adhere to the target media travel path 2, the media 90 is thereby ultimately and advantageously urged to successfully enter the decurler nip 63.

Figure 5:
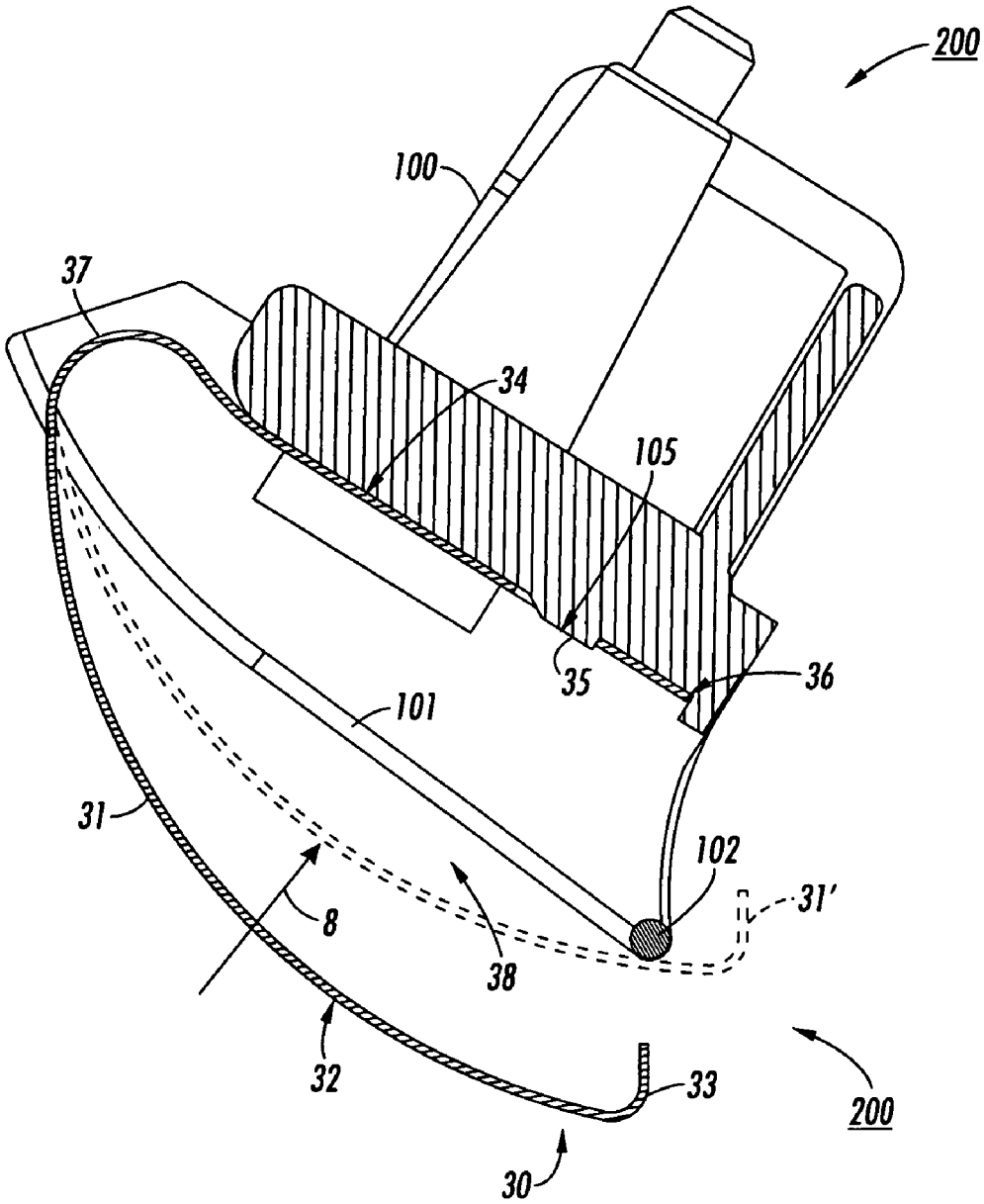
FIG. 5 is an attached cutaway profile view of the one or more flexible media travel adjusting means 30 and the baffle 100.

Referring now to FIG. 5 there is shown a profile view of the one or more flexible media travel adjusting means 30 and the baffle 100.

As depicted in FIG. 5, a flexible media travel adjusting means 30 includes a flexible media travel adjusting media guide member, or finger 31 and a base mounting member 34, the foregoing members 31 and 34 being joined at a flexible media travel adjusting means juncture 37.

Still referring to FIG. 5, in one embodiment a force 8 of about 1.5 ounces is applied as shown to the flexible media travel adjusting media guide member 31 to thereby cause the member 31 to travel towards and ultimately touch or contact the baffle flexible media travel adjusting media guide member travel stop or over-travel feature 102. The act or event of the flexible media travel adjusting media guide member 31 touching or contacting the baffle flexible media travel adjusting media guide member travel stop 102 is depicted by reference number 31' in FIG. 5. As shown, the flexible media travel adjusting media guide member and the base mounting member 34 cooperate to enclose and surround an inner flexible media travel adjusting means hollow 38.

Figure 6:
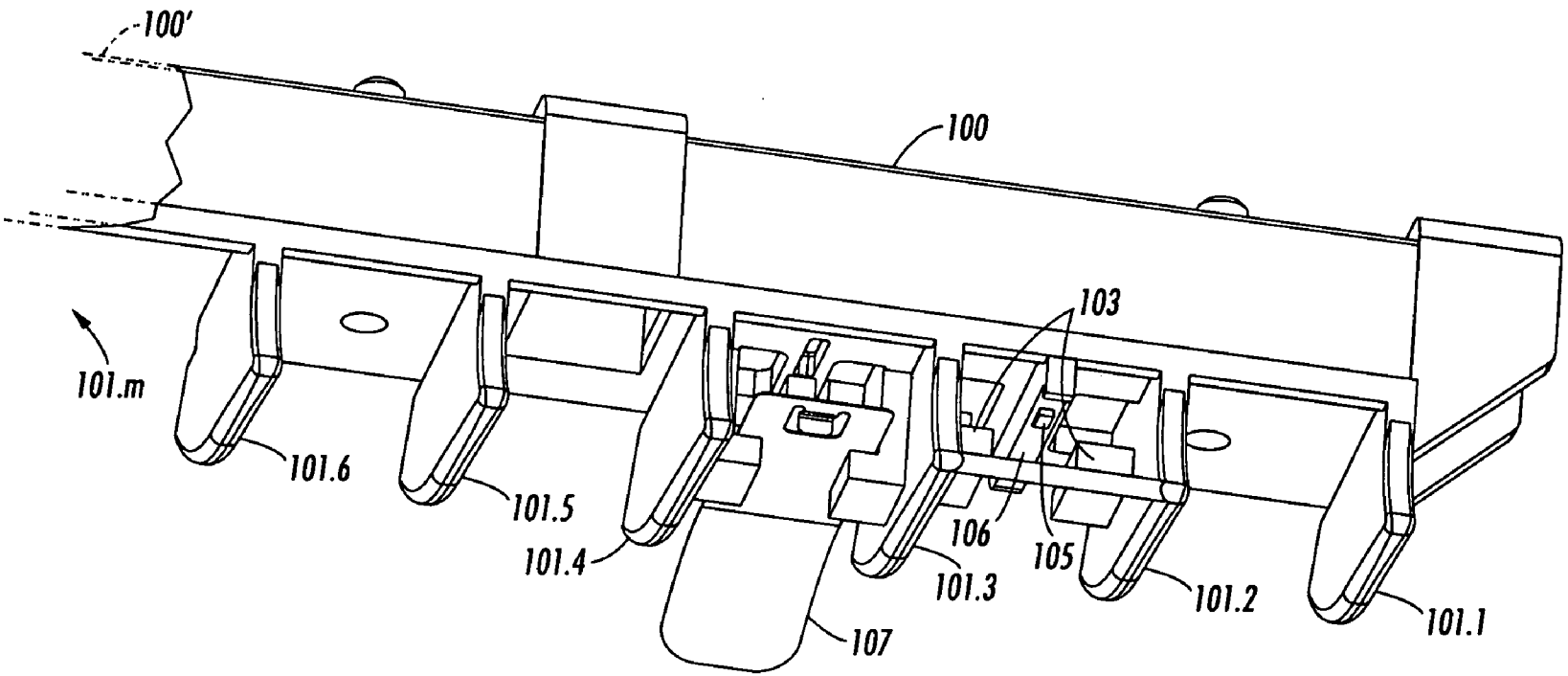
FIG. 6 is a detached perspective view of the baffle 100, by itself, and devoid of the one or more flexible media travel adjusting means 30.

Referring now to FIG. 6 there is shown the baffle 100, by itself, and devoid of any flexible media travel adjusting means 30. As shown, the baffle 100 includes a plurality of quantity "n" baffle media travel guide means or ribs 101. While the baffle 100 is depicted in FIG. 6 as having a fixed quantity, namely, six (6), thus "n" equals 6, of plural ribs 101 respectively designated 101.1, 101.2, 101.3, 101.4, 101.5 and 101.6, in another embodiment the quantity "n" of media travel guide means or ribs 101 equals any integral number greater than 1, such as 5, 7, 8, 9, 10, 15, 20, 25, 30, etc.

Still referring to FIG. 6, in one embodiment the baffle 100 is extended to include an arbitrary integral number, say "m", of plural ribs 101. This latter extended embodiment is depicted by reference number 100' in FIG. 6, wherein each individual rib 101 of the plurality of "m" ribs is respectively depicted by the set of individual reference numbers "101.1" through "101.m".

Figure 7:
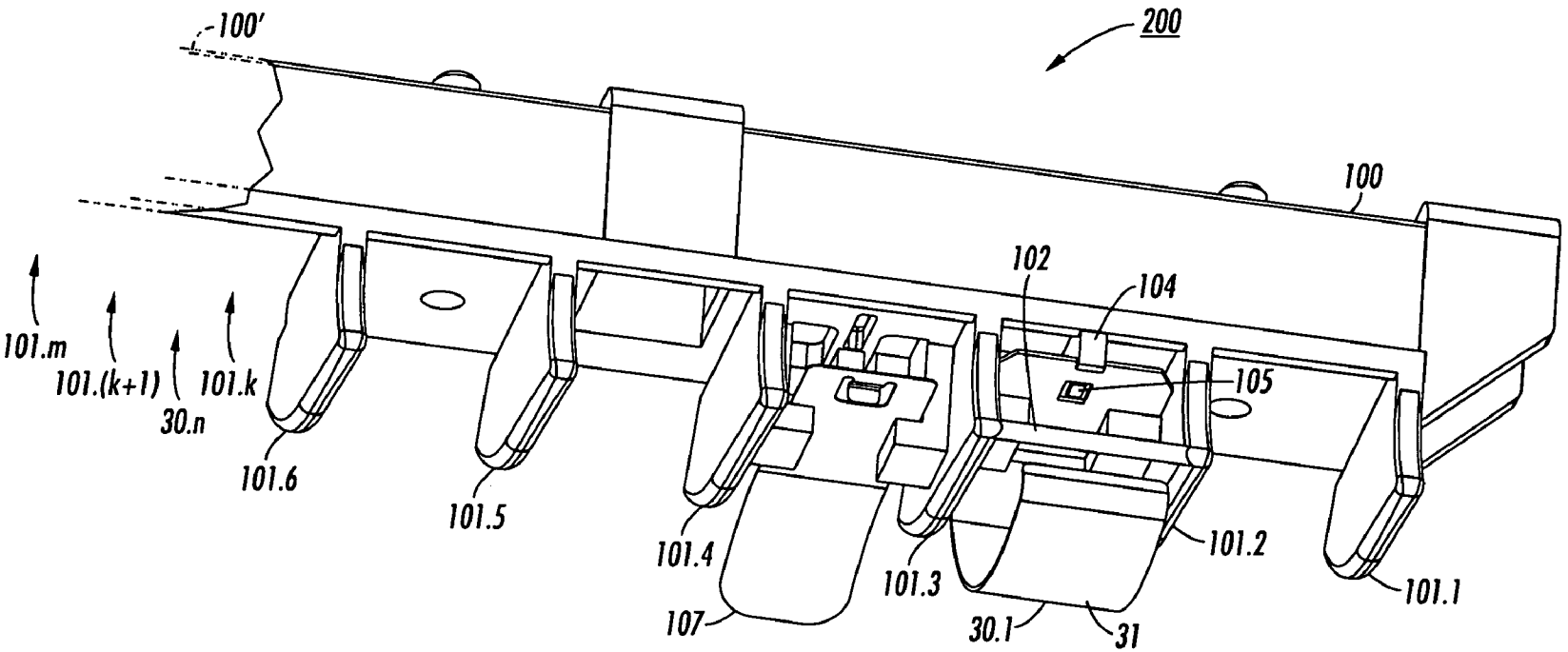
FIG. 7 is a detached perspective view of the one or more flexible media travel adjusting means 30 and the baffle 100.

Referring now to FIG. 7 there is shown the one or more flexible media travel adjusting means 30 and the baffle 100. As shown, the one or more flexible media travel adjusting means 30 includes at least one (1) flexible media travel adjusting means 30 depicted by reference number 30.1.

Still referring to FIG. 7, in one embodiment the baffle 100 is extended, the resulting extended baffle 100 being depicted by reference number 100'.

Referring still to FIG. 7, in one embodiment the resulting extended baffle 100' is arranged to include an arbitrary integral number, say "n", of plural flexible media travel adjusting means 30. In this latter extended baffle embodiment 100', each individual flexible media travel adjusting means 30 of the plurality of "n" flexible media travel adjusting means is respectively depicted by a set of reference numbers "30.1" through "30.n".

As shown in FIG. 7, each individual flexible media travel adjusting means 30 is supported, fixed, mounted, located, fastened, situated, positioned or disposed between adjacent plural media travel guide ribs 101. Thus, in the extended baffle embodiment 100' depicted as comprising a plurality of "n" flexible media travel adjusting means, the first flexible media travel adjusting means 30.1 is depicted as being disposed between its two (2) immediately adjacent travel guide ribs respectively designated 101.2 and 101.3.

Still referring to the extended baffle embodiment 100' of FIG. 7, the "n-th" member of the set of "n" plural flexible media travel adjusting means, such "n-th" flexible media travel adjusting means being depicted by reference number 30.n, is depicted as being disposed between its two (2) immediately adjacent travel guide ribs, which two (2) immediately adjacent travel guide ribs are respectively depicted by the reference numbers 101.k and 101.(k+1) in FIG. 7.

Figure 8:
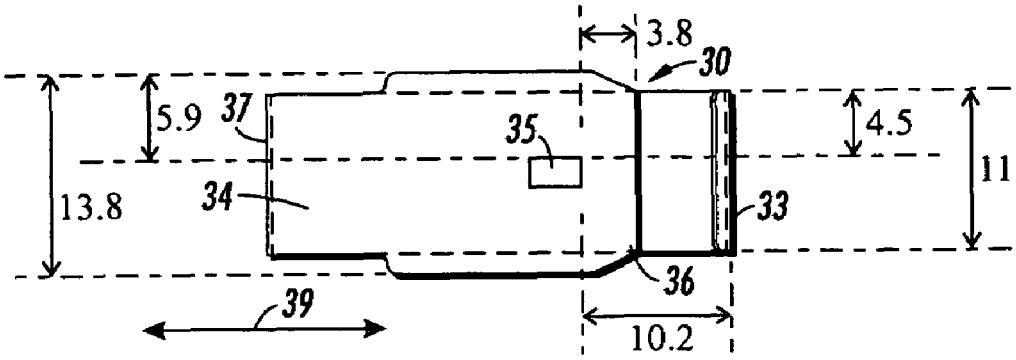
FIG. 8 is a detached elevated top-down "birds eye" view of one embodiment of an individual flexible media travel adjusting means 30.

Referring now to FIG. 8 there is an elevated top-down "birds eye" view of one embodiment of an individual flexible media travel adjusting means 30. In one embodiment, the flexible media travel adjusting means 30 is comprised of full hard stainless spring steel. In another embodiment, the flexible media travel adjusting means 30 is comprised of another material or substance that is different from and not the same as the aforementioned "full hard stainless spring steel" material.

In FIG. 8 all depicted dimensions are expressed in units of millimeters or "mm".

Figure 9:
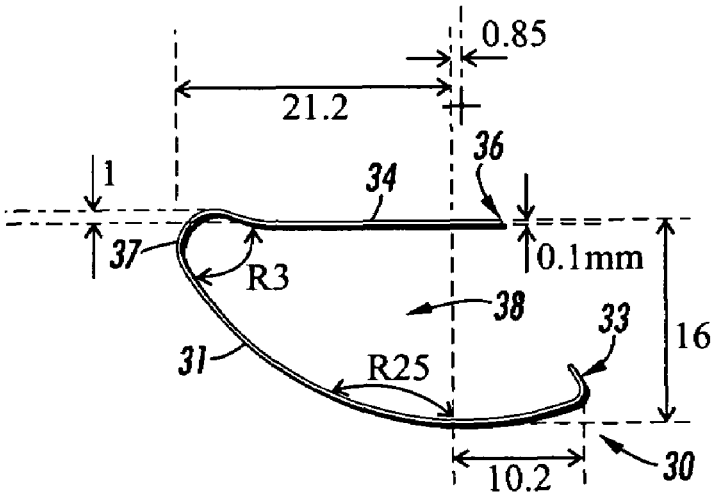
FIG. 9 is an attached cutaway side view of the FIG. 8 flexible media travel adjusting means 30.

Referring now to FIG. 9 there is shown a cutaway side view of the FIG. 8 flexible media travel adjusting means 30.

Figure 10:
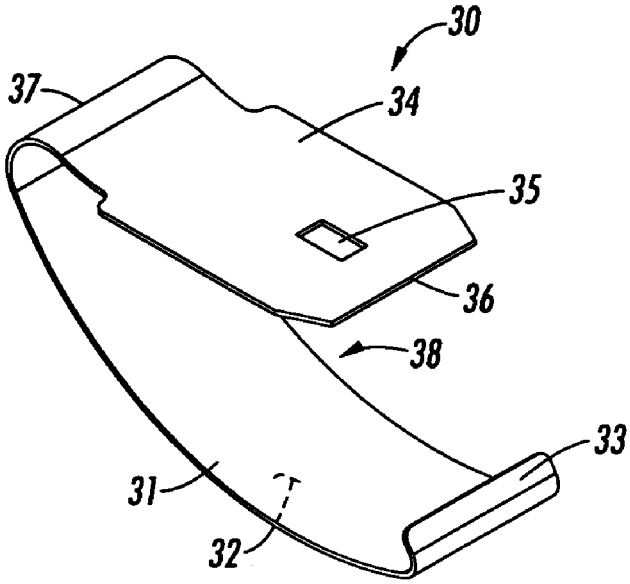
FIG. 10 is a detached elevated perspective view of the FIG. 8 flexible media travel adjusting means 30.

Referring now to FIG. 10 there is shown a perspective view of the FIG. 8 flexible media travel adjusting means 30.

Figure 11:
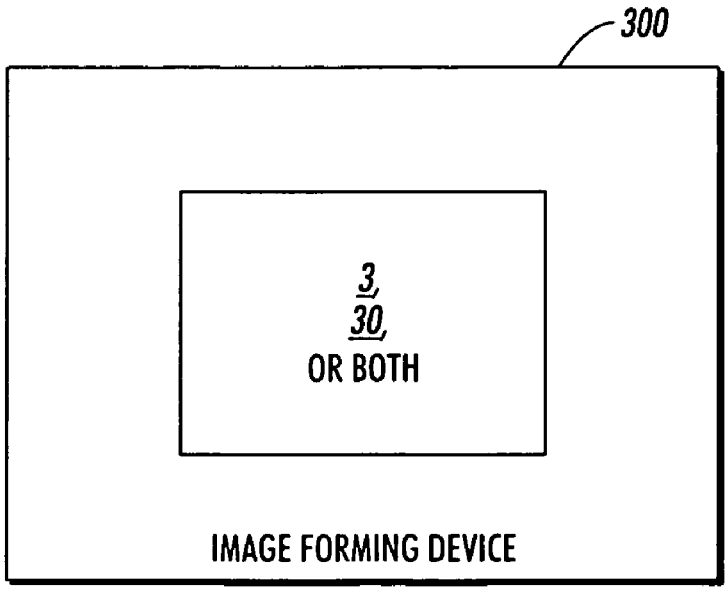
FIG. 11 is a block diagram depicting an image forming device 300 comprising one or more flexible media travel adjusting means, wherein the one or more flexible travel adjusting means comprise any combination of one or more of the flexible media travel adjusting means 3 depicted in FIG. 2 and the flexible media travel adjusting means 30 as depicted in FIGS. 3-10.

Referring now to FIG. 11 there is a block diagram of an image forming device 300 comprising one or more flexible media travel adjusting means, wherein the one or more flexible travel adjusting means comprise any combination of one or more of the flexible media travel adjusting means 3 depicted in FIG. 2 and the flexible media travel adjusting means 30 as depicted in FIGS. 3-10.

Referring now generally to FIGS. 1-10, there is described an image forming device 300 comprising one or more flexible media travel adjusting means 3 or 30 arranged to apply a media travel adjusting force 4 to a printed media 90, the printed media 90 thereby being urged and guided to follow an adjusted media travel path 7. In one embodiment, the image forming device 300 comprises one or more flexible media travel adjusting means 3 as described hereinabove in connection with FIG. 2. In another embodiment, the image forming device 300 comprises one or more flexible media travel adjusting means 30 as described hereinabove in connection with FIGS. 3-10. In a further embodiment, the image forming device 300 comprises any combination of the flexible media travel adjusting means 3 of FIG. 2 and the flexible media travel adjusting means 30 of FIGS. 3-10.

Further, the flexible media travel adjusting means 3 and 30 comprises one or more fingers 3 and 31 made of an suitable flexible material. In one application, the flexible fingers 3 and 31 are positioned between the fuser assembly 40 and decurler assembly 60. The flexible fingers 3 and 31 provide support to light weight printed media 90 when entering to the decurler nip 63 and, by controlling the media 90, the corresponding media travel is more predictable. In contrast, for heavy weight media 90, the fingers 3 and 31 deflect as depicted by reference number 4 in FIGS. 2 and 4.

In another embodiment, the flexible fingers 3 and 31 comprise a rigid baffle structure mounted on a movable base or springs.

Some advantages of providing the flexible media travel adjusting means 3 and 30 in the host image forming device 300, in accordance with the present invention, are now described.

As known, a 51 mm ding is a defect created when a printed media 90 misses the decurler nip 63 and hit the decurler roll 61. At this instant, the imbalanced force of the printed media 90 stops the media 90 momentarily. When the printed media 90 is momentarily stopped, the fuser roll 41 sucks the printed media 90 back, thereby creating a permanent deformation (defect) on the printed media 90.

In contrast, providing the flexible media travel adjusting means 3 and 30 in the host image forming device 300, in accordance with the present invention, enable the trajectory of the printed media 90 to be control, thus advantageously enabling the printed media to avoid hitting the decurler roll 60, thus minimizing or eliminating the 51 mm defect.

Thus, one advantage of the present invention is that it reduces document jams. Another advantage of the present invention is that it reduces document defects.

In summary, flexible fingers 3 and 31 are used to guide printed sheets 90 from the fuser nip into the decurler assembly 60. The use of flexible fingers 3 and 31 fabricated of any suitable material such as, for example, spring steel, provides a means of guiding without over-constraining, as would be the case with a fixed, rigid baffle, heavyweight sheets, while at the same time providing baffle control of lightweight sheets to prevent stubbing on the decurler roll 61. Stubbing or a momentary hesitation of sheet movement at the decurler can cause copy quality defects created at the fuser 40. Thus, the fingers 3 and 31 flex for heavy paper, but not for light paper.

Thus, there is described the first aspect of the invention, namely, apparatus 200 comprising one or more flexible media travel adjusting means 30 disposed on an included baffle 100; the one or more flexible media travel adjusting means 30 arranged to face a proximate fuser stripper baffle 50; and the one or more flexible travel adjusting means 30 arranged to guide a traveling media 90 towards a decurler nip 63 of a proximate decurler assembly 60.

In one embodiment, the first aspect comprises exactly two (2) flexible travel adjusting means 30.

In another embodiment, the first aspect comprises exactly three (3) flexible travel adjusting means 30.

In a further embodiment, the first aspect comprises exactly four (4) flexible travel adjusting means 30.

In another further embodiment, the first aspect comprises a plurality of flexible travel adjusting means 30.

In yet a further another embodiment of the first aspect, at least one of the one or more flexible media travel adjusting means 30 comprises a flexible media guide finger 31.

In yet another embodiment of the first aspect, the baffle 100 includes plural media travel guide ribs 101, at least one of the one or more flexible media travel adjusting means 30 being disposed between adjacent plural media travel guide ribs 101.

In a yet further embodiment of the first aspect, the at least one flexible media travel adjusting means 30 is comprised of stainless spring steel.

Also, there is described the second aspect of the invention, namely, an image forming device 300 including one or more flexible media travel adjusting means 30 disposed on an included baffle 100; the one or more flexible media travel adjusting means 30 arranged to face a proximate fuser stripper baffle 50; and the one or more flexible travel adjusting means 30 arranged to guide a traveling media 90 towards a decurler nip 63 of a proximate decurler assembly 60.

In one embodiment, the second aspect comprises exactly two (2) flexible travel adjusting means 30.

In another embodiment, the second aspect comprises exactly three (3) flexible travel adjusting means 30.

In a further embodiment, the second aspect comprises exactly four (4) flexible travel adjusting means 30.

In another further embodiment, the second aspect comprises a plurality of flexible travel adjusting means 30.

In still yet a further another embodiment of the second aspect, at least one of the one or more flexible media travel adjusting means 30 comprises a flexible media guide finger 31.

In another and yet still further embodiment of the second aspect, the baffle 100 includes plural media travel guide ribs 101, at least one of the one or more flexible media travel adjusting means 30 being disposed between adjacent plural media travel guide ribs 101.

In a further and still yet another embodiment of the second aspect, the at least one flexible media travel adjusting means 30 is comprised of stainless spring steel.

In yet still another and still yet a further another embodiment, the second aspect comprises any of a printer, a copier and a facsimile device.

Also, there is described the third aspect of the invention, namely, an image forming device 300 comprising one or more flexible media travel adjusting means 3 and 30 arranged to apply a media travel adjusting force 4 to a printed media 90, the printed media 90 thereby being urged and guided to follow an adjusted media travel path 7.

In one embodiment of the third aspect, the one or more flexible media travel adjusting means 30 are disposed on an included baffle 100; the one or more flexible media travel adjusting means 30 arranged to face a proximate fuser stripper baffle 50 and to guide a traveling media 90 towards a decurler nip 63 of a proximate decurler assembly 60.

In another embodiment of the third aspect, the baffle 100 including plural media travel guide ribs 101, at least one of the one or more flexible media travel adjusting means 30 being disposed between adjacent plural media travel guide ribs 101.

The table below lists the drawing element reference numbers together with their corresponding written description:

No.: Description:

1 process or "downstream" direction
2 target media travel path
3 one or more flexible media travel adjusting means
3.1 . . . 3.n flexible media travel adjusting means
4 one or more media travel adjusting force(s)
4.1 . . . 4.n media travel adjusting force(s)
5 non-target media travel path
6 non-target media travel path
7 adjusted media travel path
8 compression force
10 baffle
11 baffle media travel guide means, or rib(s)
19 media leading edge contacting flexible media travel adjusting means
30 one or more flexible media travel adjusting means
30.1 . . . 30.n flexible media travel adjusting means
31 flexible media travel adjusting media guide member, or finger
31' flexible media travel adjusting media guide member—contacting baffle travel stop

32 flexible media travel adjusting media guide member outer surface
33 flexible media travel adjusting media guide member distal end
34 flexible media travel adjusting base mounting member
35 flexible media travel adjusting base mounting member lock receptacle
36 flexible media travel adjusting base mounting member distal end
37 flexible media travel adjusting means—juncture
38 flexible media travel adjusting means—hollow
39 flexible media travel adjusting means—grain direction
40 fuser assembly
41 heated fuser roll
42 fuser pressure roll
50 fuser stripper baffle
51 fuser stripper baffle media travel guide means
60 decurler assembly
61 decurler roll
62 decurler foam roll
63 decurler nip
64 decurler light weight media entrance aperture, or throat
65 decurler heavy weight media entrance aperture, or throat
90 media or paper
91 media leading edge
92 media leading edge vector
100 baffle
100' baffle extended
101 baffle media travel guide means, or rib(s)
101.1 . . . 101.m baffle media travel guide means, or rib(s)
102 baffle—flexible media travel adjusting media guide member travel stop
103 baffle—flexible media travel adjusting means lower support
104 baffle—flexible media travel adjusting means stop
105 baffle—flexible media travel adjusting means lock plug
106 baffle—flexible media travel adjusting means upper support
107 baffle pressure roll stripping finger
200 one or more flexible media travel adjusting means 30 disposed on baffle 100
300 image forming device including one or more flexible media travel adjusting means 3 and 30

While particular embodiments have been described hereinabove, alternatives, modifications, variations, improvements and substantial equivalents that are or may be presently unforeseen may arise to applicants or others skilled in the art. Accordingly, the appended claims as filed and as they may be amended are intended to embrace all such alternatives, modifications, variations, improvements and substantial equivalents.

What is claimed is:

1. Apparatus to guide flexible media into a decurler nip of an image forming device, said apparatus comprising:

an included baffle interposed between a fuser assembly and a decurler assembly, said included baffle being located above and oriented perpendicularly to a target media travel path for said flexible media; and a linear array of one or more flexible media travel adjusting means disposed on a longitudinal axis of said included baffle, each of said one or more flexible media travel adjusting means comprising a flexible finger extending beneath said included baffle and above said target media travel path, said flexible finger being oriented approximately parallel to a surface of said target travel media path and in a direction of said target travel media path, wherein:

each said flexible finger flexes in a direction perpendicular to said surface of said target travel media path; and an extent of flexion of said each said flexible finger comprises a throat for said flexible media to travel into said decurler nip of said decurler assembly by said target media travel path.

2. The apparatus of claim 1, said included baffle including a plurality of media travel guide ribs, such that each of said one or more flexible media travel adjusting means is disposed between an adjacent pair of media travel guide ribs.

3. The apparatus of claim 1, wherein said one or more flexible media travel adjusting means comprise stainless spring steel.

4. The apparatus of claim 1, wherein said extent of flexion of said each said flexible finger encloses a first adjusted media travel path for lightweight flexible media and a second adjusted media travel path for heavyweight flexible media.

5. The apparatus of claim 1, wherein said extent of flexion has an upper bound provided by a travel stop for each of said one or more flexible media travel adjusting means located on a base of said included baffle.

6. An image forming device that guides flexible media from a fuser assembly into a decurler nip of a decurler assembly, said device comprising:

said fuser assembly;

said decurler assembly; and a linear array of one or more flexible media travel adjusting means interposed between said fuser assembly and said decurler assembly, wherein:

said linear array is located above and oriented perpendicularly to a target media travel path;

each of said one or more flexible media travel adjusting means comprises a flexible finger that extends toward said target media travel path and is oriented approximately parallel to a surface of said target travel media path and in a direction of said target travel media path;

each said flexible fingers flexes in a direction perpendicular to said surface of said target travel media path; and an extent of flexion of said each said flexible finger guides said flexible media to travel into said decurler nip by said target media travel path.

7. The image forming device of claim 6, wherein said array of one of the one or more flexible media travel adjusting means is located on an included baffle located above and oriented perpendicularly to said target media travel path.

8. The image forming device of claim 7, said included baffle including a plurality of media travel guide ribs, such that each of said one or more flexible media travel adjusting means is disposed between an adjacent pair of media travel guide ribs.

9. The image forming device of claim 7, wherein said extent of flexion of said each said flexible finger encloses a first adjusted media travel path for lightweight flexible media and a second adjusted media travel path for heavyweight flexible media.

10. The image forming device of claim 7, wherein said extent of flexion has an upper bound provided by a travel stop for each of said one or more flexible media travel adjusting means located on a base of said included baffle.

11. The image forming device of claim 6, wherein said one or more flexible media travel adjusting means comprise stainless spring steel.

12. The image forming device of claim 6 comprising any of a printer, a copier and a facsimile device.

13. An image forming device comprising:

a linear array of one or more flexible media travel adjusting means interposed between a fuser assembly and a decurler assembly, said linear array being located above and oriented perpendicularly to a target media travel path for flexible media, wherein:

each of said one or more flexible media travel adjusting means is arranged to apply a downward media travel adjusting force to said flexible media, such that said flexible media is guided to said target media travel path, which enters a decurler nip of said decurler assembly without defect.

14. The image forming device of claim 13, wherein said one or more flexible media travel adjusting means are disposed on an included baffle.

15. The image forming device of claim 14, wherein said included baffle comprises a plurality of media travel guide ribs, such that each of said one or more flexible media travel adjusting means is disposed between a pair of adjacent media travel guide ribs.

16. The image forming device of claim 13, wherein each of said one or more flexible media travel adjusting means flexes in a direction perpendicular to said surface of said target travel media path.

17. The image forming device of claim 16, wherein an extent of flexion of said each said one or more flexible media travel adjusting means guides said flexible media to travel into said decurler nip by said target media travel path.

18. The image forming device of claim 17, wherein said extent of flexion of said each said one or more flexible media travel adjusting means encloses a first adjusted media travel path for lightweight flexible media and a second adjusted media travel path for heavyweight flexible media.

19. The image forming device of claim 17, wherein said extent of flexion has an upper bound provided by a travel stop for each of said one or more flexible media travel adjusting means located on a base of said included baffle.

20. The image forming device of claim 13, wherein said each of said one or more flexible media travel adjusting means comprises stainless spring steel.

* * * * *